US005949328A

United States Patent [19]

Latty

[11] Patent Number: 5,949,328

[45] Date of Patent: Sep. 7, 1999

[54] APPARATUS AND METHOD FOR LOCATABLE ENCODING ALARMS

[76] Inventor: James A. Latty, 26912 Calle Esperanza, San Juan Capistrano, Calif. 92675

[21] Appl. No.: 08/397,982

[22] Filed: Mar. 3, 1995

[51] Int. Cl.[6] ..... G08B 27/00

[52] U.S. Cl. ..... 340/326; 340/309.15; 340/321; 340/539; 340/573; 340/825.49

[58] Field of Search ..... 340/326, 321, 340/309.15, 309.3, 573, 691, 568, 825.49; 341/176

[56] References Cited

U.S. PATENT DOCUMENTS

| | | | |
|---|---|---|---|
| 3,315,166 | 4/1967 | Crump | 340/321 |
| 3,493,966 | 2/1970 | Human | 340/384 |
| 3,693,110 | 9/1972 | Briggs et al. | 331/47 |
| 4,057,769 | 11/1977 | Woolf | 331/49 |
| 4,101,873 | 7/1978 | Anderson et al. | 340/539 |
| 4,507,653 | 3/1985 | Bayer | 340/573 |
| 4,742,357 | 5/1988 | Rackley | 340/825.49 |
| 4,770,114 | 9/1988 | Malone | 340/825.49 |
| 5,121,096 | 6/1992 | Moore et al. | 340/309 |
| 5,204,657 | 4/1993 | Prosser | 340/568 |
| 5,294,915 | 3/1994 | Owen | 340/309.15 |

*Primary Examiner*—Jeffery A. Hofsass
*Assistant Examiner*—John Tweel, Jr.

[57] ABSTRACT

Apparatus and method for locatable alarms which increase the awareness of and locatability of objects, even for sight or hearing impaired individuals. The apparatus emits preferably a plurality of intermittent complex multiple frequency encoded noises at ear intensities less than 150 dbA, when measured at 10 cm from the source, which enhance listeners' conscious or subconscious abilities to estimate both the distance to the object from the listeners and at least two relative angles between the listeners and the object. The plurality of intermittent complex multiple frequency encoded noises include noise having at least in part primary frequency less than about 1.1 KHz and noise having primary frequency in the range of from about 4 KHz through about 12 KHz. Additionally, the apparatus provides encoded light, preferably an encoded, near monochromatic, coherent, pulsed light of less than 5 milliwatt intensity having primary output wavelengths in the range of from about 380 nanometers through about 780 nanometers, the light emitted by the object being encoded with balanced and selected saturation purity, interference, chromaticity, pulse duration, luminous flux and coherence that enhance viewers' ability to consciously or subconsciously estimate both the distance to the object and at least two angles between the viewers and the object, resulting in heightened alarm, awareness, and locatability for a large percentage of human beings.

25 Claims, 8 Drawing Sheets

SINGLE PULSE ENCODED OUTPUT SOUND INTENSITY VS. TIME, ONE HIGH EAR INTENSITY DURATION

REPETITIVE PULSE ENCODED OUTPUT SOUND INTENSITY VS. TIME, HIGH & LOW EAR INTENSITY DURATIONS

LISTENER EAR APPARENT ENCODED OUTPUT SOUND INTENSITY FROM A PLURALITY OF APPARENT SOUND SOURCES VS. TIME – SPATIAL & TEMPORAL SOUND INTERFERENCE PATTERNS

SINGLE PULSE, COHERENT, NEAR MONOCHROMATIC, ENCODED LIGHT INTENSITY VS. TIME, HIGH LIGHT INTENSITY DURATION

REPETITIVE PULSE OUTPUT COHERENT,
NEAR MONOCHROMATIC ENCODED LIGHT INTENSITY VS. TIME

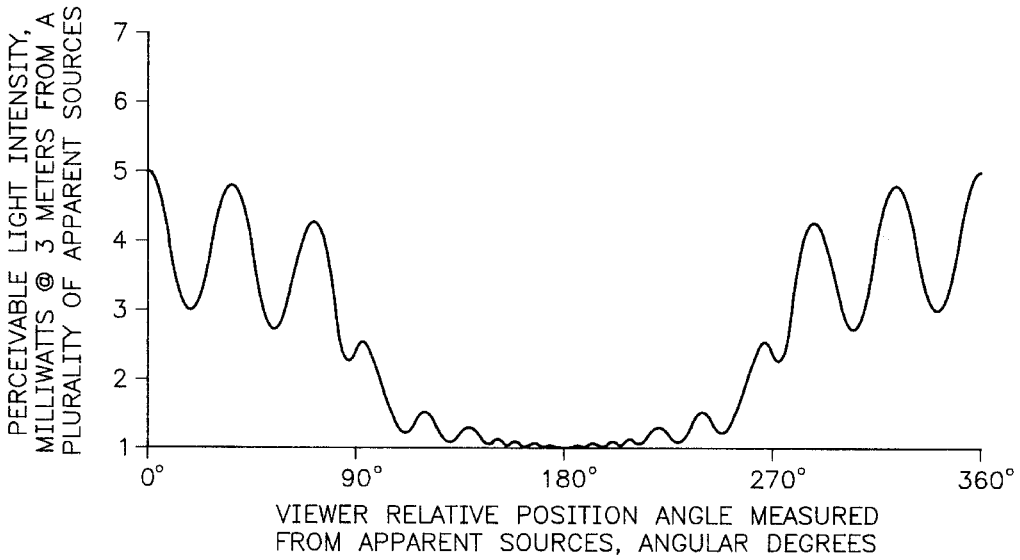
FIG. 9 PERCEIVABLE ENCODED LIGHT INTENSITY FROM A PLURALITY OF APPARENT LIGHT SOURCES VS. ANGULAR POSITION OF VIEWER, MEASURED FROM THE MIDPOINT OF THE LIGHT SOURCES – SPATIAL LIGHT INTERFERENCE PATTERN
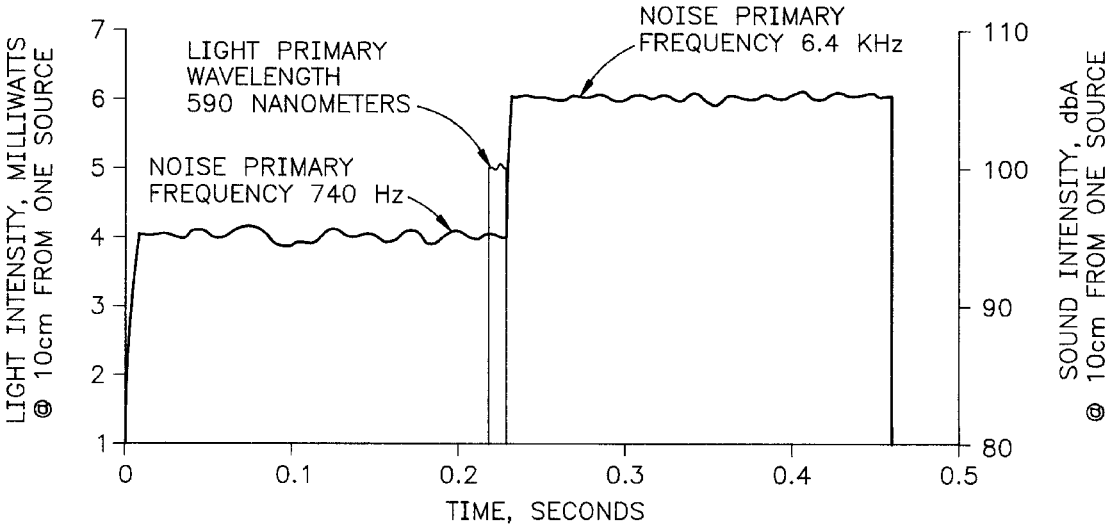
FIG. 10 COMBINED AURAL AND VISUAL ENCODED OUTPUT STIMULI INTENSITY VS. TIME

LOCATABLE ENCODING AURAL AND
VISUAL STIMULI GENERATOR

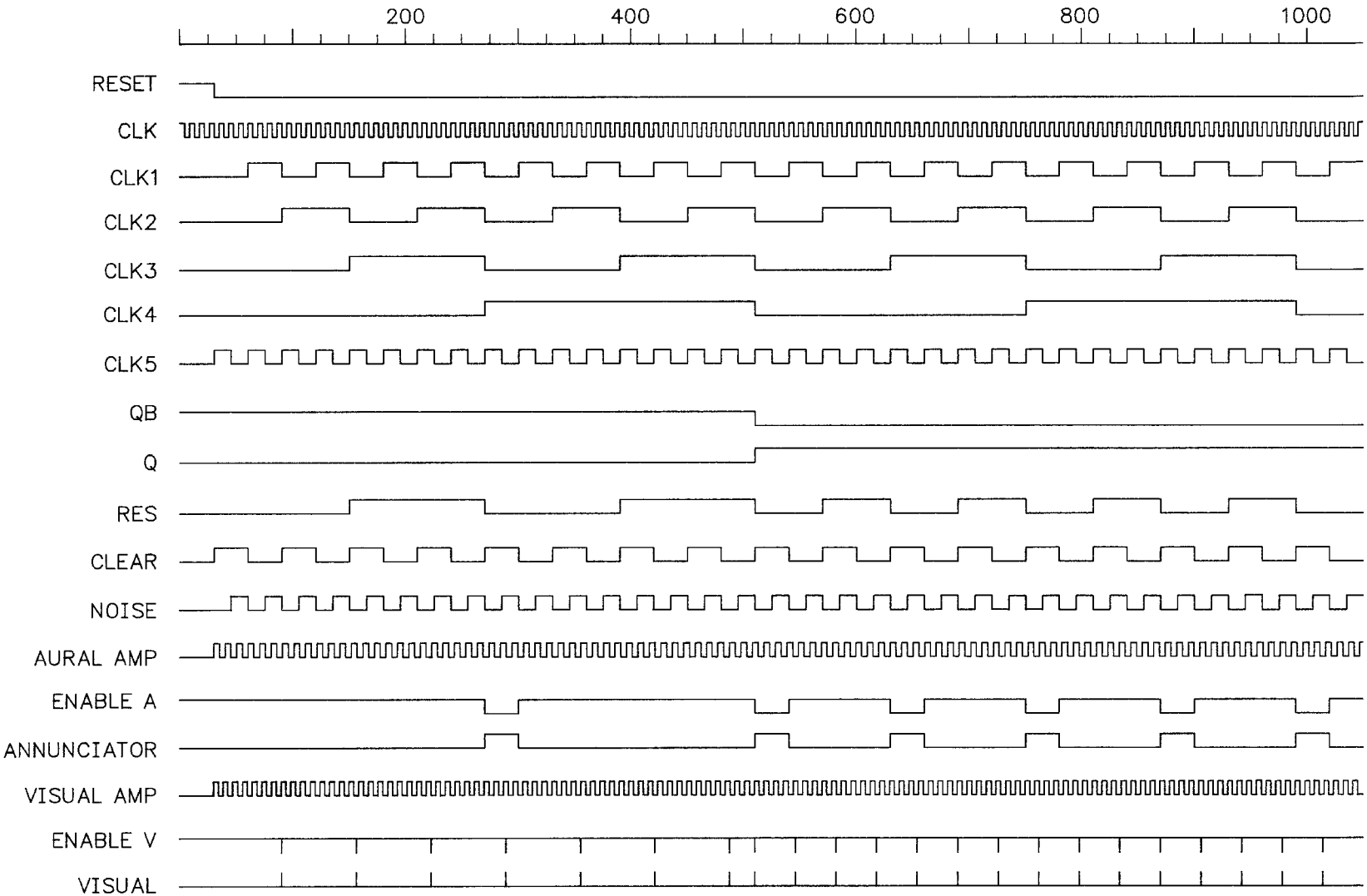
FIG. 12 ILLUSTRATION OF INTERNAL TIMING DIAGRAM OF SIGNAL RELATIONSHIPS WITHIN THE PREFERRED EMBODIMENT

APPARATUS AND METHOD FOR LOCATABLE ENCODING ALARMS

BACKGROUND OF THE INVENTION

1. Field of the Invention

The present invention relates to the field of sensory stimulation and, more particularly, to method and apparatus for producing encoded aural and/or visual stimuli that significantly improve alarm, awareness and object locatability for human beings.

2. Description of the Related Art

In the past, devices that produce sound or light have been proposed as locator aids. Assistance in locating misplaced or lost objects is a widespread need. Assistance is needed when emergency equipment or surgical devices are misplaced; when a lost object may be easily damaged if inadvertently physically contacted; and when a lost object, such as a weapon, would be dangerous where lost or if accidently or unknowingly encountered. The needs for compact, effective and long lived apparatus and method for producing sensory stimulations which enhance human alarm, awareness and locatability are very important to human safety. Additionally, everyday objects such as keys, eye glasses, credit cards, wallets, portable telephones, office equipment and remote controls for entertainment equipment are easily misplaced. Often it is time consuming, difficult and frustrating to locate them. The present invention greatly improves and enhances alarm, awareness and source locatability for a large percentage of people when it is applied to, or integrated with, these or similar objects. As such, the present invention represents a significant advancement over currently available sound beepers or light flashers.

This invention, based on unexpected and unanticipated human physiological and psychological responses, overcomes certain drawbacks associated with currently available beepers or flashers which can be difficult to locate. Currently available beepers or flashers fail to effectively stimulate specific human conscious and subconscious physiological and psychological reactions that enhance alarm, awareness and locatability.

The present invention solves these problems by providing a low cost, compact, effective, long lived, power efficient and portable apparatus and method for producing new and novel encoded aural and/or visual sensory stimuli. These aural and/or visual stimuli greatly enhance alarm, awareness and locatability for a large percentage of human beings, including those who have only partial hearing and those with certain vision impairments.

U.S. Pat. No. 3,493,966 to A. T. Human on Feb. 3, 1970 for Electronic Audible Alarm Devices Having Plural Oscillators relates to a dual function horn/siren having a coupling between the two sound generating functions. This device has a siren produced by a variable voltage source and a horn produced by two oscillators with different frequency outputs driving the same speaker in a fixed relationship, with one oscillator being variable. There is no suggestion for producing a locatable apparatus, nor does this patent suggest producing encoded aural stimuli.

U.S. Pat. No. 3,693,110 to C. A. Briggs, Jr., et al., on Sep. 19, 1972 for an Audible Signal or Alarm Device Including Two Variable Frequency Unijunction Transistor Oscillators relates to an electrical circuit that includes a pair of unijunction transistors, an amplifier, a speaker and a switch. This device provides adjustable output signals that may be steady or have varying frequency with different rates for varying output signals and different basic frequency signals. The circuit can be modified to give programmed output signals. There is no suggestion for producing a locatable device or encoding aural stimuli.

U.S. Pat. No. 4,057,769 to L. D. Woolf on Nov. 8, 1977 for a Circuit for Generating Two Distinctive Tone Bursts with Exponentially Decaying Envelopes relates to an electrical circuit which generates an electrical signal at one or the other of two predetermined frequencies. This circuit also has an attenuator that over time varies a controlled burst of oscillations at the two frequencies. This device is described as being combined with an alarm for public address systems and not as a locatable apparatus.

U.S. Pat. No. 4,631,517 to K. J. Ajland on Dec. 23, 1986 for a Frequency-Matched Signal Device for Persons with Impaired Hearing relates to an adjustable tone alarm that produces one or two tones matched to the specific audiogram of a particular hearing impaired individual. The apparatus disclosed is not a locatable device and only simple tones are employed. This device does not generate complex encoded sound or light that would enable a person to locate an object, nor does this device coordinate the sound with the sensory sensitivity of more than one person in order to produce a tone or tones that are audible by a large percentage of the population.

U.S. Pat. No. 5,121,096 to H. A. Moore, et al., on Jun. 9, 1992 for Position Locating Device relates to a light and sound alarm which is pulsed on and off by a common driver signal of fixed timing. Only one specific simple sound, a pure 2.5 KHz tone at 70 Db <sic>, is mentioned. No attention is directed toward generating sound and/or light which could heighten a person's alarm, alertness or ability to determine the source's location. Accordingly, the sound and light emitted by the device disclosed are difficult for a person to localize.

U.S. Pat. No. 5,204,657 to R. A. Prosser on Apr. 20, 1993 for a Locating Device has a locating circuit containing an oscillator/counter logic circuit, a reset circuit, a reset beep circuit, an enable flip-flop, a delay flip-flop, a mux flip-flop, a mux logic circuit and a piezo oscillator circuit. The device is generally used to locate a misplaced television remote control or credit card. It discloses three sets of varying length beeps.

The present invention solves many alarm and awareness problems for a large percentage of human beings, especially for the hearing impaired and those with certain non-correctable vision impairments in situations where locating an object is difficult. The present invention enhances alarm, alertness and locatability. Previous devices fail to enhance human abilities to rapidly estimate the relative distance to the object and at least two relative angles between the human beings and the object.

SUMMARY OF THE INVENTION

The present invention is directed to novel apparatus and method for greatly enhancing alarm, awareness and object locatability for human beings by the modification or emission of novel and uniquely encoded sensory stimuli. These aural and/or visual stimuli are in the forms of complex combinations of primary frequencies (wavelengths), durations, intensities, rise and delay time characteristics, apparent multiple sources and interference patterns. These features enhance human physiological and psychological reactions and greatly improve the conscious or subconscious effectiveness of the alarm, awareness and the persons' estimation of the source's relative location. In addition, the invention produces specific intensity and intermittent duration encoded sensory stimuli that, among other benefits, conserve energy. This device is compact, portable, long lived, and highly effective. The invention provides encoded stimuli which enable some partially sensory-handicapped human beings to perceive no fewer than three object specific location characteristics—distance and at least two relative angles.

In general, the present invention provides a novel apparatus and method for providing encoded sensory stimuli in the forms of noise and/or light which greatly enhance human beings' alarm, awareness and locatability of objects. The invention is preferably applied to or integrated with easily misplaced, dangerous, important or hard to find objects. When standing alone, the present apparatus includes its own power supply and switch. When integrated with a host object, it may share power supply and other support functions. It provides specially encoded sound and/or modifies or emits specially encoded light. Based on human being response physiology and psychology, these stimuli greatly enhance effective conscious or subconscious alarm, awareness and source locatability for a large percentage of the human population. This includes those who have only partial hearing and/or those with certain vision impairments.

The present invention is partially based on the fact that human beings respond with unexpectedly heightened sensitivity to specially encoded wave form stimuli (visible light spectrum electromagnetic radiation and audible spectrum adiabatic compression acoustic waves) in unique conscious or subconscious physiological and psychological ways. These stimuli greatly enhance human alarm, awareness and ability to locate emitters of these stimuli. Unique aural and visual stimuli characteristics are encoded by this invention to heighten perception. Enhanced perception is helpful to all people and is needed especially by people who are high frequency hearing impaired (the most common form of hearing impairment) and by people who are colorblind (a common form of non-correctable vision impairment).

Human beings have varying sensitivities to aural stimulations. These sensitivities depend upon the following major characteristics of sounds or noises:

1. Loudness (sometimes called ear intensity);
2. Primary tone (frequency);
3. Sound duration;
4. Purity of frequency (tone);
5. Combinations of tones (complex noise);
6. Familiarity of the listener with the noise (repetition and familiarity);
7. Profiles of sound intensity increase and decrease versus time;
8. Environmental dampening and interference (background);
9. Primary phase of the sound relative to the listener;
10. Position of the noise source relative to the listener;
11. Acoustic interference patterns produced by constructive and destructive interference of matched tones from more than one apparent source; and
12. Coordination of noise with non-aural stimuli (visual, vibrational, odor and other sensory stimuli).

In one aspect of the invention, the method and apparatus for increasing the awareness of and locatability of an object by individuals include an apparatus to produce and the steps to cause the object to produce noise and aural stimuli. The sound or noise provided by the object is encoded with information from which individuals can estimate relative distance to the object. Also, the sound provided by the object is encoded with information from which individuals can estimate at least two relative angles between themselves and the object.

Preferably, the sound includes complex multiple frequency encoded noise. This type of noise enhances the locatability of the object even for individuals having only one functional ear. In addition, preferably there are a plurality of complex multiple frequency encoded noises. One complex multiple frequency encoded noise has a primary frequency less than about 1.1 KHz and sharp sound intensity level rise times. This produces sound phase shifts that occur between both of the listeners' ears which enables listeners to estimate at least two relative angles between the listeners' locations and the location of the object. Estimates of distance to the object by listeners are also enhanced by such a noise through tone-loudness shifts which are perceived to occur as the listeners move relative to the noise source.

Another complex multiple frequency encoded noise includes a primary frequency in the range of from about 4 KHz through about 12 KHz. These sounds produce apparent sound shadows, aiding relative angular direction estimation by listeners. These enable the listeners' ears facing toward the emitter to detect a significantly higher sound intensity than the ears on the opposite side of the listeners' heads (e.g., a difference in sound intensity levels greater than approximately 10 dbA between their ears as the listeners turn their heads). Front to back listener source locatability is also improved by noise in this primary frequency range and sensitivity to environmental attenuation is reduced.

The apparatus and method additionally include means for and steps of pulsing at least one of the plurality of complex multiple frequency encoded noises to produce high ear intensity and low ear intensity level durations. Sound shadow encoding and listener recognition are thereby enhanced and power consumption is reduced. Noise is produced in high ear intensity levels that are greater in sound intensity than approximately 50 dbA and are in the duration range of from about 0.01 through about 0.6 second. Conversely, low ear intensity levels are less than an intensity of 50 dbA and in the duration range of from about 0.1 through about 45 seconds. All intensities are measured at about 10 cm from the sound emitting object.

Apparatus and methods further include the additional step of causing the object to produce the plurality of complex multiple frequency encoded noises in at least one repeated pattern. The resultant listener familiarity enhances recognition over background sounds. The complex multiple frequency encoded noise has a rapid ear intensity level rise time produced by an apparatus having an electronic loudspeaker driver circuit with an RC time constant in the range of from approximately 0.1 through approximately 1.0 millisecond. The complex multiple frequency encoded noise produced has a high apparent ear intensity, enhanced relative angle recognition of the sound source relative to the listeners, enhanced distance identity, and a low sound source power requirement. Noise is emitted from a plurality of noise output apertures and/or a plurality of matched noise sources. The plurality of apparent complex multiple frequency encoded noises produces acoustic interference patterns which enhance human estimation of relative distance to and relative angular orientation of the noise sources. The apparent complex multiple frequency encoded noise is polydirectional. This enables listeners to hear it from a plurality of angles relative to the sound emitter for enhanced locatability.

This invention includes the provision of method and apparatus for encoding and producing aural stimuli that cause human being mental/auditory systems to perceive a sound phase difference (phase shift or difference in sound arrival times) between the listeners' ears. The ear facing the sound emitter and detecting the first arrival of the leading edge of the sound acoustic wave is perceived as being closer to the stimuli source. Such sounds facilitate enhanced listener estimation of the emitter's relative angular location when encoded as low primary frequency (less than approximately 800 Hz), as discontinuous, sharp ear intensity level rise time sounds.

The present invention provides a method and apparatus for encoding and producing noise of a high ear intensity level (in the range from 50 to 150 dbA measured at 10 cm from the emitter) that can be detected by a significant percentage of human beings. It also emits multiple sounds of different ear intensities and low primary frequencies so as to enhance listeners' distance estimation upon approach through differential rising apparent ear intensities. The invention encodes and emits high intensity sounds of sufficient duration to enhance locatability. Because these sounds are emitted for durations in the range of from about 0.01 through about 0.6 second, they contain an ear detectable primary frequency; they enhance estimation of the relative angular direction of the sound's origin; and they stimulate high ear apparent loudness sensations. Yet, the sounds are not so loud as to potentially damage human auditory response.

The apparatus or means for providing said noise further has means for generating sound substantially in the high ear intensity level range of from 50 dbA through 150 dbA, when measured at about 10 cm from an origin of said noise. The means for providing noise further includes means for providing high ear intensity level complex encoded noise at primary frequencies substantially in the range of 740 Hz at high ear intensity levels substantially in the range of 88 dbA, measured at about 10 cm from the source of said complex encoded noise and also means for providing high ear intensity level complex encoded noise at primary frequencies substantially in the range of 6.4 KHz at high ear intensity levels substantially in the range of 95 dbA, measured at about 10 cm from the source of said complex encoded noise. There are means for providing pulsed durations of said high ear intensity level complex encoded noise at primary frequencies substantially in the range of said 740 Hz and substantially in the range of said 6.4 KHz and means for providing high ear intensity level complex encoded noise comprising durations substantially in the range of from 0.01 through 0.6 second. There are means for providing low ear intensity level noise, at ear intensity levels of 50 dbA and less, as measured at about 10 cm from the source of said low ear intensity level noise, and means for providing durations of said low ear intensity level noise, between said durations of said high ear intensity level complex encoded noise, which are initially and substantially for the first 4 minutes of operation substantially in the range of 16 seconds. There are means for providing durations of said low ear intensity level noise, between said durations of said high ear intensity level complex encoded noise, which after substantially the first 4 minutes of operation are substantially in the range of 4 seconds and means for providing said low and high ear intensity level noise from an apparent plurality of locations. There are also means for providing said low and high ear intensity level noise from, at least in part, an encodable annunciator circuit having an RC time constant substantially in the range of from approximately 0.1 through about 1.0 millisecond and means for providing said high ear intensity level complex encoded noise for periods substantially in the range of about 0.23 second.

Human beings have also been observed to have varying sensitivities to visual stimuli, depending on the following major characteristics of the light:

A. Intensity (brightness);
B. Color (primary wavelength);
C. Duration of visibility (flash);
D. Purity of primary color or a combination of colors (hue);
E. Familiarity of the observer with the appearance of the source (color, shape, glitter, etc.);
F. Temporal variations of light intensity;
G. Susceptibility of the light to environmental dampening, interference and observer confusion;
H. Coherence;
I. Refraction;
J. Reflection;
K. Polarization;
L. Diffraction;
M. Dispersion;
N. Position of the light source relative to the observer;
O. Interaction of light to produce interference patterns; and
P. Coordination of light with non-visual stimuli (aural, vibration, odor, etc.).

In another aspect, the invention generally features method and apparatus for increasing awareness of and locatability of an object by individuals. The additional method and apparatus include the means to and steps of causing a light to be modified and/or emitted by the object. The light provided by the object is visible encoded light containing information perceivable as aiding viewers to consciously or subconsciously estimate the relative distance to the object from the individuals and aiding viewers to consciously or subconsciously estimate at least two angles between the object and the individuals.

Preferably, the method and apparatus modify and/or emit light, including light that is encoded normally visible light. The modified normally visible light is modified and encoded by at least one of a light refractor, a light filter, a light lens, a light reflector, a light polarizer, a light defractor, a light emitting electrical arc, a florescent light, an electroluminescent light, a chemiluminescent light, an incandescent light, a light amplification by simulated emission of radiation (laser) and a light disperser. The produced normally visible encoded light generation is done by at least one of a light emitting diode, a vapor arc, a florescent light source, an electroluminescent, a chemiluminescent, an incandescent, and a light amplification by stimulated emission of radiation (laser) light. The produced encoded light is in the wavelength range of from about 380 nanometers through approximately 780 nanometers and is normally visible. The encoded normally visible light further may be in the wavelength band of from approximately 555 nanometers through 595 nanometers and be essentially yellow or amber light which is visible to most colorblind individuals. The encoded normally visible light typically is pulsed so as to produce repetitive high and low intensity durations. The high intensity durations of the normally visible light are in the range of from about 0.0001 second through about 0.1 second. The low intensity durations are in the range of from about 0.01 second through about 45 seconds. The normally visible light is also encoded and produced at primary wavelengths and for high and low intensity durations producing both high lumen sight efficiency and high light producing source power efficiency. The encoded produced light is typically near monochromatic, coherent light, apparent from a plurality of apertures and potentially producing constructive and destructive interference patterns which aid viewers to consciously or subconsciously estimate the relative distance between the object and the viewers and also to estimate at least two relative angles between the object and the viewers, as well as producing enhanced visual acuity or causing chromatic aberrations of the eye which aid a large percentage of human beings to estimate the object's location. The encoded produced light apparatus and method heighten human location perception by being substantially balanced among the light properties of saturation purity (hue), luminous flux (brightness) and visible chromaticity (dominant wavelength) and impart a substantially high visual sensation of brightness and a substantially high light generating source power efficiency. The encoded produced light apparatus and method repeatedly pulse the mostly visible light with the following substantially repeated balanced primary light properties—luminous flux, chromaticity, and saturation purity—thereby producing high viewer ocular response and recognizability of the light.

The apparatus and method for producing encoded modified and/or emitted light additionally incorporates a light beam splitter and means and method for generating near monochromatic light interference patterns. The near monochromatic light interference patterns are encoded with spatial location information that is consciously or subconsciously estimatable by viewers. The mostly visible encoded light producing apparatus and method additionally provide and/or divide light from an apparent plurality of locations by means including apparatus from at least one of a fiber optic, a mirror, a prism, a plurality of coordinated light sources, a plurality of light orifice, and a polydirectional light source. The apparatus is compact and portable. The apparatus and method are combined with an object to substantially increase human alarm awareness and locatability of the object. The apparatus and method are integrated with an object in order to increase human alarm, awareness and locatability of the object. The apparatus and method for producing aural and visual stimuli are combined, whereby enhancing human being alarm, awareness and locatability of objects.

A method for increasing awareness of and locatability of an object by individuals, said method includes the steps of: providing noise aural stimuli; providing said noise aural stimuli from which said individuals may consciously and subconsciously estimate the relative distance between said individuals and said object; providing said noise aural stimuli from which said individuals may consciously and subconsciously estimate at least two relative angles between said individuals and said object; providing light visual stimuli; providing said light visual stimuli from which said individuals may consciously and subconsciously estimate the relative distance between said individuals and said object; and providing said light visual stimuli from which said individuals may consciously and subconsciously estimate at least two relative angles between said individuals and said object.

One object of the present invention is the provision of novel method and apparatus for encoding and producing aural stimuli by manipulating at least one of the above listed said 12 major encodable sound characteristics in order to enhance the conscious or subconscious alarm, alert and locatability for a large percentage of human beings.

Another object of the invention is the provision of method and apparatus for encoding and producing repeated pulses of encoded sound that minimize the distraction caused by interfering environmental background sounds.

A still further object of the invention is the provision of method and apparatus for encoding and providing auditory stimulating noise that consciously or subconsciously improves object alarm, alert and locatability for people with significant partial hearing impairments caused by auditory nerve or hearing deterioration which can occur in one or both ears and impair peoples' abilities to be alerted by, alarmed by, or to estimate the location of a sound's source.

Yet another object of the invention is the provision of method and apparatus for careful matching of single or multiple encoded sound characteristics, and the provision of a sound producer which facilitates peoples' rapid localization of the sound emitter by consciously or subconsciously estimating three relative localization characteristics—distance and at least two relative angles between the aural producer and the peoples' locations.

Yet another object of the invention is the provision of method and apparatus for encoding and producing multiple encoded complex tones (noises) for enhanced localization, since localization of simple, pure or fine tones is difficult but complex noise emissions enhance listeners' resolution of aural stimuli from background sounds and enhance detection of encoded acoustic information, such as phase shift, sound shadow, ear intensity and primary frequency, which enable distance and relative angularity to be estimated quickly by listeners. Complex noise, however, can often be localized by people with only one functional ear.

Yet another object of the invention is the provision of method and apparatus for encoding and producing complex noises in a primary frequency band range including approximately 4 KHz through approximately 12 KHz that cause a perceivable sound shadow, such that the listeners' ears facing toward the emitter detect a significantly higher sound intensity than the ears on the opposite sides of the listeners' heads (e.g., greater than approximately 10 dbA difference between the two ears as the listeners turn their heads) so that the sound emitter's position angles relative to both of the listeners' ears can be estimated as an additional aid in locating the sound emitter.

Another object of the invention is the provision of method and apparatus for encoding and producing aural stimuli that cause human being mental/auditory systems to perceive a sound phase difference (phase shift or difference in sound arrival times) between listeners' two ears, such that ears facing the sound producer and detecting the first arrival of the leading edge of the sound acoustic wave are perceived as being closer to the stimuli source, such sounds facilitating enhanced listener estimation of the producer's relative angular location when encoded as low primary frequency, less than approximately 800 Hz, as discontinuous, and as sharp ear intensity level rise time sounds.

A still further object of the invention is the provision of method and apparatus for encoding and producing high ear intensity noise (in the range from 50 to 150 dbA measured at 10 cm from the producer) that can be detected by a significant percentage of human beings, yet not so loud as to potentially damage human auditory response, and also to emit multiple such sounds of different ear intensities and primary frequencies so as to enhance listeners' distance estimation upon approach through differential rising apparent ear intensities.

Another object of the invention is the provision of method and apparatus for encoding and producing high ear intensity repeated sounds of sufficient duration, such that listeners quickly become familiar with the sounds' characteristics to aid subsequent location estimation over background or interfering sounds, and lasting in the duration range of from about 0.01 through about 0.6 second thus containing an ear detectable primary frequency, as well as being encoded with estimatable relative angular direction and high ear apparent loudness.

Yet another object of the invention is the provision of method and apparatus for encoding and producing encoded sounds with emission durations of low sound intensity between durations of high sound intensity. The low intensity durations are in the range of from approximately 0.1 through approximately 45 seconds and the high sound intensity durations are in the range of from approximately 0.01 through approximately 0.6 second. As a result, listeners are neither excessively irritated by, nor ignore the sounds. The high sound intensity durations can also carry significant encoded aural information and the brief sound durations can be produced by a low power, compact, portable, low cost, long lived sound generator.

A yet further object of the invention is the provision of method and apparatus for encoding and combining multiple encoded complex sounds of different ear intensities and primary tones, such that locatability of the emitter is enhanced by the combination of multiple sound characteristics.

Yet another object of the invention is the provision of portable and long-lived, cost-effective electrical, electronic and/or electromechanical sound producing apparatus which at least in part greatly enhance the acoustically encoded location information while conserving energy, and, when sound generation is electronic, have a loud speaker driver circuit resistance-capacitive (RC) time constant in the range of from approximately 0.1 through approximately 1.0 millisecond, with the emitted sounds having short ear intensity rise times and high apparent ear intensities, thus facilitating high ear apparent aural power conversion efficiencies for sounds emitted by the chosen circuit elements.

A still further object of the invention is provision of method and apparatus for encoding and producing complex sounds in low primary sound frequency bands, such that a tone-loudness shift is achieved. That is, the invention enhances human auditory response alarm, alert and location estimation by producing encoded sounds with primary frequencies in the range of from approximately 0.5 KHz through approximately 2.0 KHz which listeners perceive to grow disproportionately louder as the sound emitter is approached, because human hearing is generally more sensitive to these sounds.

A further object of the invention is the provision of method and apparatus for encoding and producing split output or multiple sources of interacting encoded sounds which generate constructive and destructive acoustic interference patterns that enhance human alarm and alertness as well as enhance distance and angularity estimation of the sound's source.

Still another object of the invention is the provision of sound producing apparatus and method that, when used alone, or when used in combination with other similar devices and methods, encode and produce polydirectional sound capable of being heard by human beings from a plurality of angles relative to the sound emitter for enhanced alarm, awareness and locatability.

A still further object of the present invention is the provision of novel method and apparatus for encoding, modifying and/or emitting visual stimuli by manipulating at least one of said major encodable light characteristics, A through P, to aid a large percentage of human beings to be alarmed by, made aware of, and to enhance their conscious or subconscious effectiveness at locating the visual stimuli producer (localization).

Another object of the invention is the provision of method and apparatus for enhancing source locatability by modifying and/or producing repeated pulses of encoded visual stimuli which minimize the distraction of interfering environmental background light.

Still another object of the invention is the provision of method and apparatus for producing primary visual stimuli with encoded characteristics that facilitate human beings' rapid locatability of the visual stimuli's source by aiding viewers to consciously or subconsciously estimate three localization characteristics—distance and at least two relative angles between the viewer and the visual stimuli source.

Yet another object of the invention is the provision of method and apparatus for encoding produced multiple wavelength visual stimuli that enhance source localization.

A further object of the invention is the provision of method and apparatus for producing near monochromatic light encoded to stimulate great visual acuity (sharpness), or to stimulate the perception of chromatic aberrations of the eye, and thus to alarm and alert a large percentage of human beings and aid them to estimate the location of the visual stimuli's source.

Yet another object of the invention is the provision of method and apparatus for encoding produced temporally intermittent (pulsed) visual stimuli, thus facilitating efficient visual stimulations with minimal energy consumption, and thereby providing an efficient, portable, compact, long life, low power drain, high ocular efficiency visual stimulation, locating, alarm and awareness aid. The high intensity light durations being in the range of from approximately 0.0001 through approximately 0.1 second, with high illumination efficiency and low energy losses, for example in the form of heat. The low light intensity periods between high intensity periods having durations in the range of from approximately 0.01 through approximately 45 seconds. Such stimuli are neither irritants nor ignored and they may have apparent information encoded in the intermittent pulses.

It is a further object of the invention to provide method and apparatus for encoding produced visual stimuli that elicit high levels of conscious or subconscious alarm and human being ocular response with minimal visual stimuli generator energy use, and having balanced luminous flux (brightness), widely humanly visible chromaticity (dominant wavelength), and saturation purity, since it has been discovered that human ocular response and locatability are not the same for equal power outputs of radiant flux of different wavelengths of light, because identical power levels of different wavelengths of light stimulate human beings to perceive visual sensations of different brightness.

Another object of the invention is to provide method and apparatus that produce encoded light at high enough optical intensity so as to be readily seen, but not so high as to cause ocular damage, which for example for near monochromatic coherent light produced by light amplification by stimulated emission of radiation is in the range of from approximately 0.05 through approximately 5.0 milliwatts of output power.

Another object of the invention is the provision of apparatus (e.g., reflectors, refractors, polarizers, diffractors, dispersers, lenses and filters) and method for encoding and producing light to enhance alarm and conscious or subconscious human being source locatability, due at least in part to the fact that the modified light, according to one aspect of the invention, has dominant luminous flux, chromaticity and saturation purity in the primary yellow wavelength band because it has been observed that yellow light has characteristics visible to a large percentage of humans, including those with common anomalous red and green color blindness, protanomalous color blindness, deuteranomalous color blindness and both typical and atypical types of monoduomatism color blindness, thereby enabling a large percentage of human beings to estimate the location of the source of the visual stimuli.

It is a further object of the invention to provide novel method and apparatus for encoding produced multiple apparent sources of matched coherent light which cause constructive and destructive near monochromatic light interference patterns that may be seen to spatially focus viewers' attention to the source, thereby enhancing the visual stimuli source's alarm, awareness and locatability.

Another object of the invention is the provision of method and apparatus for encoding produced split light, using means such as fiber optic, mirror, prism, a plurality of light orifices, and polydirectional light in order to give the appearance of light when observers view the object from a plurality of angles, thereby enhancing multidirectional alarm and locatability.

A still further object of the invention is the provision of method and apparatus for enhancing alarm and human being locatability through producing visually identifiable encoded light, differentiable by attributes such as size, shape, texture, glare, flicker, sparkle, and glitter, thereby enhancing visibility by improving human familiarization and recognition of the encoded light pattern over that of background light.

Yet another object of the invention is the provision of novel, compact, portable and efficient encoding human aural and visual sensory stimulator apparatus and method for encoding, emitting, modifying, producing or otherwise providing both visual and aural stimuli to enhance human being conscious and/or subconscious alarm, alert and locatability of objects.

It is a further object of the invention to provide method and apparatus for increasing awareness of and locatability of an object by individuals through integrating encoded visual and/or aural stimuli producers into, onto, or with an object in order to enhance the alarm and locatability by human beings of said object.

BRIEF DESCRIPTION OF THE DRAWINGS

FIG. 9 is a graph depicting the inventive visual stimuli producing apparatus perceivable output encoded light intensity in milliwatts, measured at 3 meters from the mid point between two apparent light sources of the apparatus, plotted as a function of viewer relative angular position at a constant distance from the point midway between the two apparent light sources for one high light intensity duration of coherent, near monochromatic encoded light output, illustrating the encoded spatial light intensity interference patterns that vary with angular position of the viewer and are produced as results of constructive and destructive near monochromatic coherent light interference;

FIG. 10 is a graph of the combined aural and visual stimuli producing apparatus outputs showing encoded sound and light intensities measured at 10 cm from one sound and from one light source, respectively. Both are plotted as functions of time for one combined high intensity duration of multiple primary frequency complex encoded noise stimuli and for one high intensity duration of coherent, near monochromatic, encoded light stimuli;

FIG. 12 is a timing diagram of the signal relationships for the preferred embodiment.

DESCRIPTION OF THE PREFERRED EMBODIMENT

Figure 1:
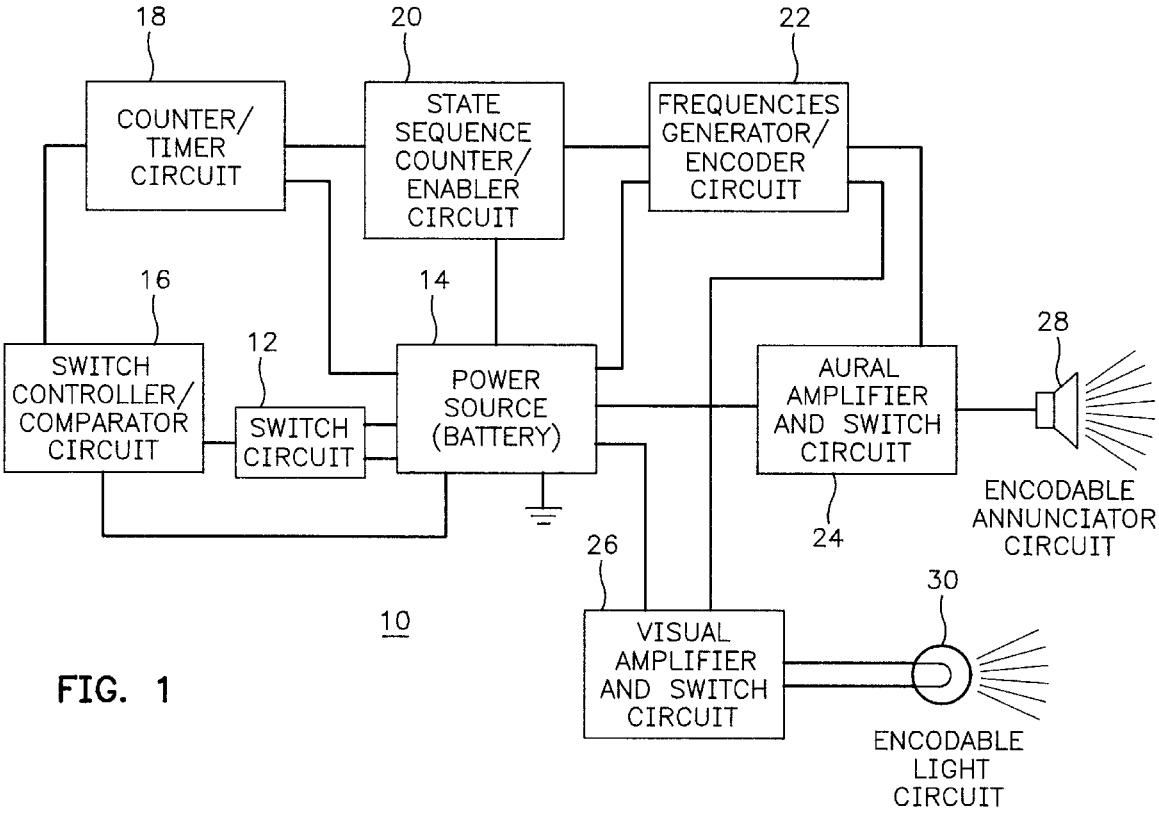
FIG. 1 is a block diagram of an aural and visual stimuli producing apparatus constructed according to the invention and illustrating the functional operation thereof.
Figure 2:
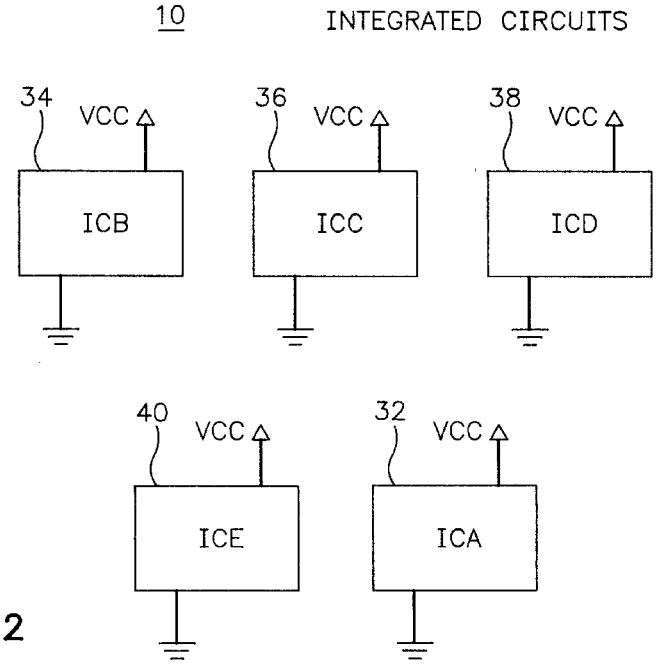
FIG. 2 is a diagram showing a number of integrated circuits employed in the inventive aural and visual stimuli producing apparatus.
Figure 3:
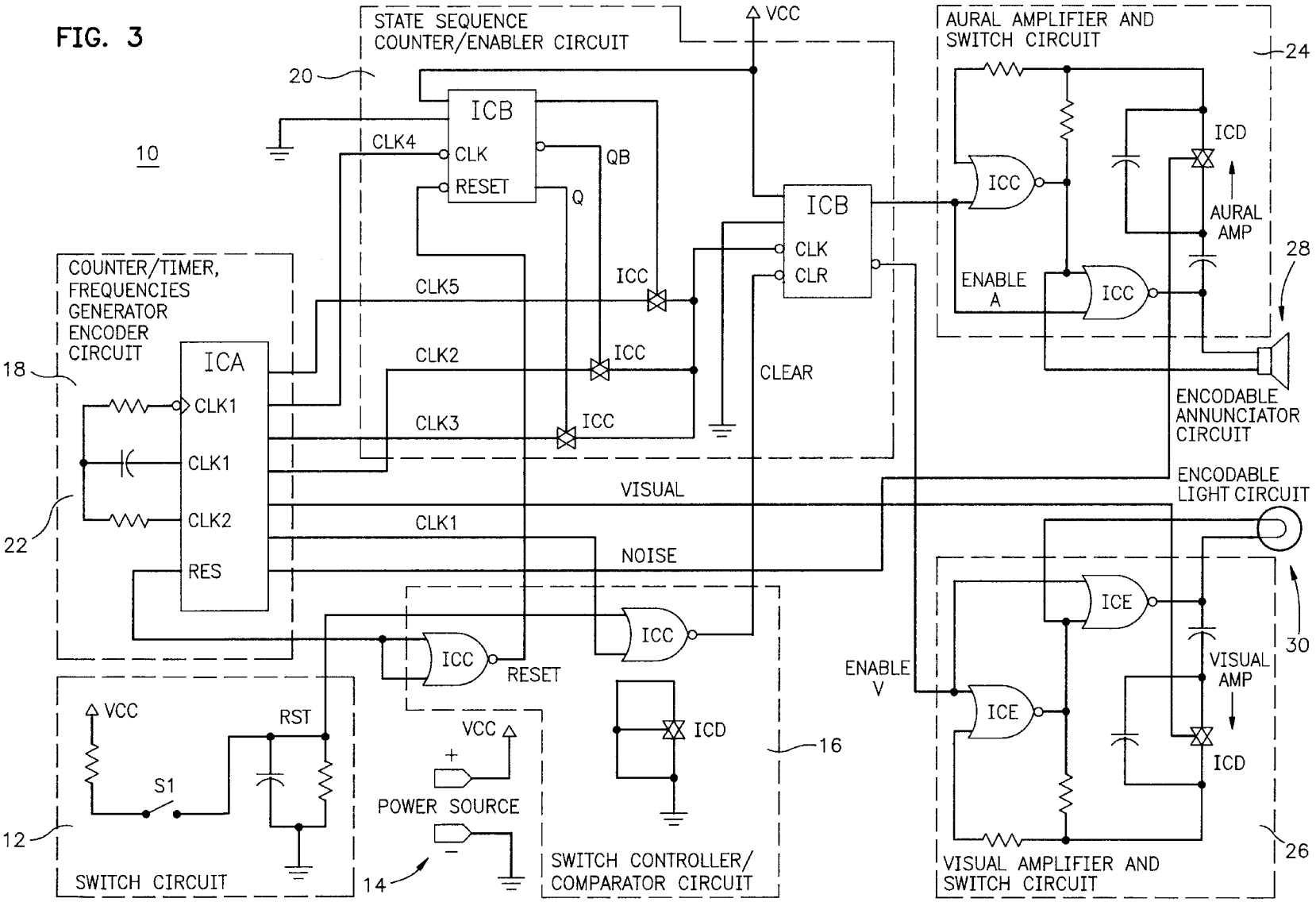
FIG. 3 is a schematic diagram of the inventive aural and visual stimuli producing apparatus and illustrating S1 as a resistance sensitive switch.

Referring to FIGS. 1 through 12, an apparatus, which may be made of discrete and integrated circuit elements, or of an application specific integrated circuit with additional discrete elements for locatable encoding alarms 10 is shown and described in which the Counter/Timer, Frequencies Generator Encoder circuit 18 and 22 has multiple counter flip-flops that generate clock signals, CLK, CLK1, CLK2, CLK3, CLK4 and CLK5, a visual switch control signal VISUAL and a noise switch control signal NOISE. All the counters are zeroed by the reset signal RST from the Switch Circuit 12. The relative interrelationships of the circuit signals is illustrated in FIG. 12 and described below.

The Switch Controller/Comparator circuit 16 processes the reset signal RST through a logic gate of the reset sub-circuit producing a reset signal RESET which resets the counter flip-flops to zero in the State Sequence Counter/Enabler circuit 20 and produces a clear signal CLEAR that clears the flip-flops of State Sequence circuit Counter/Enabler circuit 20.

The State Sequence Counter/Enabler circuit 20 supplies the enable signals ENABLE A to the Aural Amplifier and Switch circuit 24 and ENABLE V to the Visual Amplifier and Switch circuit 26, which then enable, respectively, the oscillator circuit in the Aural Amplifier and Switch circuit 24 that drives the Encodable Annunciator circuit 28 and the Visual Amplifier and Switch circuit 26 that drives the Encodable Light circuit 30. The Aural Amplifier and Switch circuit 24 generates an aural driver signal AURAL AMP to the Encodable Annunciator circuit 28. The Encodable Annunciator circuit 28 produces complex encoded audible noise. The Visual Amplifier and Switch circuit 26 generates a visual driver signal VISUAL AMP to the Encodable Light circuit 30. The Encodable Light circuit 30 produces visible encoded light. There is a power source 14 preferably a battery or series of batteries.

The Switch circuit 12 responds to the closure of the switch S1, with the Switch Controller/Comparator circuit 16 screening for false (i.e. high frequency) closure signals, and simultaneously triggers the Switch Controller/Comparator circuit 16 to initiate the clear signal CLEAR that initializes, and the reset signal RESET that resets the State Sequence Counter/Enabler circuit 20.

The visual trigger signal VISUAL and the noise trigger signal NOISE from the Counter/Timer, Frequencies Generator Encoder circuit 18 and 22 switch on the respective circuits in the Aural Amplifier and Switch circuit 24 and the Visual Amplifier and Switch circuit 26. As illustrated in FIG. 12, the aural and visual amplifier circuits operate substantially differently and for different intervals, thus producing distinct and separate Encodable Annunciator circuit 28 output ANNUNCIATOR and Encodable Light circuit 30 output VISUAL, also as depicted in FIG. 12.

Preferably, the Aural and Visual Stimuli Generator 10 includes the Switch Circuit 12; the resistance sensitive Switch S1; the Switch Controller/Comparator circuit 16, implemented as logic gates in ICC 36 and a switch in ICD 38; the Counter/Timer circuit 18 and the Frequencies Encoder/Generator circuit 22, primarily implemented in ICA 32; the State Sequence Counter/Enabler circuit 20, primarily implemented in ICB 34 with switches in ICC 36; the Aural Amplifier and Switch circuit 24 with logic gates in ICC 36 and a switch in ICD 38; the Visual Amplifier and Switch circuit 26 with the logic gates in ICE 40 and a switch in ICD 38; the Power Source 14 (e.g., battery) connected to the VCC terminals of the integrated circuits ICA 32 through ICE 40 and to a common electrical ground; the Encodable Annunciator circuit 28; and the Encodable Light circuit 30.

As illustrated in FIG. 12, when switch S1 in the Switch Circuit 12 is closed the reset signal RST is interrupted, the Switch Controller/Comparator circuit 16 is activated, and the Counter/Timer, Frequencies Encoder Generator circuit 18 and 22 is activated producing timing, delay, primary visual and aural signals. The counters in the State Sequence Counter/Enabler circuit 20 are cleared by the clear signal CLEAR and only initiate when no reset signal RESET is sent from the Switch Controller/Comparator circuit 16.

The State Sequence Counter/Enabler circuit 20 generates enable signal ENABLE A and ENABLE V which enable the Aural Amplifier and Switch circuit 24 and the Visual Amplifier and Switch circuit 26, respectively. The enable signals, output by the State Sequence Counter/Enabler circuit 20, gate the Aural and Visual Amplifiers circuits' logic blocks 24 and 26 on and off.

The Aural Amplifier and Switch circuit 24 drives the Encodable Annunciator circuit 28, while the Visual Amplifier and Switch circuit 26 drives the Encodable Light circuit 30. The reset signal RESET, illustrated in FIG. 12, initializes all flip-flop functions, while, during active functioning, the State Sequence Counter/Enabler circuit 20 is constantly cleared by the clear signal CLEAR from the Switch Controller Comparator circuit 16. Clock signals are generated by the Counter/Timer, Frequencies Generator Encoder circuit 18 and 22 which control the State Sequence Counter/Enabler circuit 20, allowing it to output the signals to the Aural Amplifier and Switch circuit 24 and to the Visual Amplifier and Switch circuit 26. Both the Aural Amplifier and Switch circuit 24 and the Visual Amplifier and Switch circuit 26 continue in a switch-on output mode until the enable signals ENABLE A and ENABLE V are disrupted. The enable signals ENABLE A and ENABLE V, output by the State Sequence Counter/Enabler circuit 20, enable the Aural Amplifier and Switch circuit 24 and Visual Amplifiers and Switch circuit 26 to change modes. Q and QB are internal signals in the State Sequence Counter/Enabler circuit 20 which control the multiplex switch circuits in ICC 36 that determine which clock signals set the timing of the enable signals ENABLE A and ENABLE V.

An apparatus 10 for increasing awareness of and locatability of an object (not shown) by individuals as described in Claim 10, Claim 31, Claim 32, Claim 40 and Claim 41 wherein the apparatus further comprises the step of combining said apparatus with the object (not shown).

Figure 4:
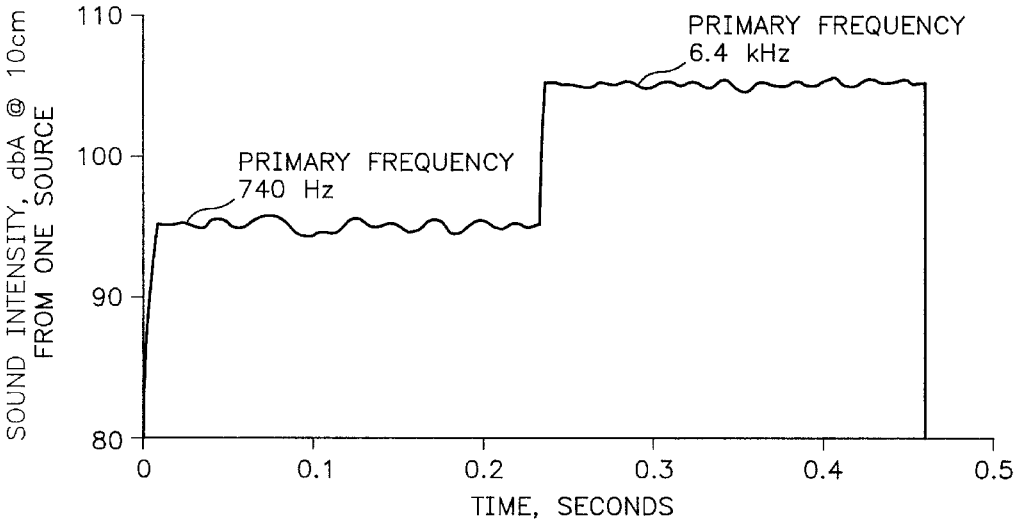
FIG. 4 is a graph of the inventive aural stimuli producing apparatus output depicting encoded sound intensity in dbA, measured at 10 cm from one source, plotted as a function of time for two durations of multiple primary frequency complex encoded high ear intensity noises.
Figure 5:
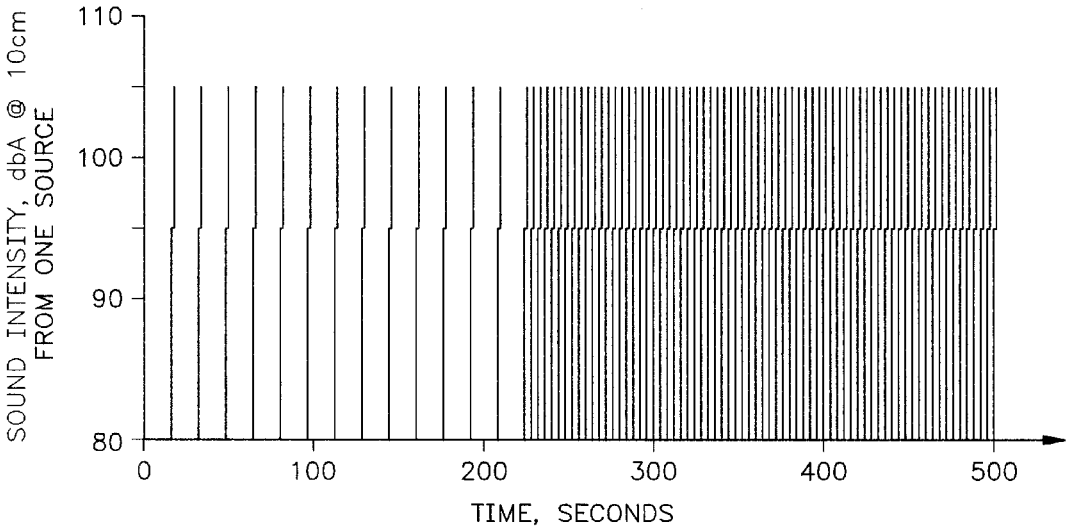
FIG. 5 is a graph of the output of the inventive aural stimuli producing apparatus depicting repetitive pulse encoded sound output intensity in dbA, measured at 10 cm from one source, plotted as a function of time for a plurality of durations of multiple primary frequency complex encoded high ear intensity noises and multiple low ear intensity durations.

The encoded aural stimuli, produced by the Encodable Annunciator circuit 28 as illustrated in FIGS. 4 and 5, are unique combinations of low and high frequency complex noises, lasting approximately 0.23 second each, are produced by an Aural Amplifier circuit 24 having an electronic loud speaker driver circuit with an RC time constant of approximately 0.3 millisecond, and are composed of multiple acoustic output intensities in the range from approximately 90 dbA through approximately 105 dbA as measured at about 10 cm from the sound source. These produced encoded acoustic stimuli preferably include at least two types of complex encoded noises, one of the complex encoded noises having a primary frequency at approximately 740 Hz and the other having a primary frequency at approximately 6.4 KHz. Preferably, the lower primary frequency noise is encoded complex noise which has a low susceptibility to environmental attenuation; stimulates wide conscious or subconscious human auditory sensitivity, including stimulation of partially hearing impaired human beings; has a phase arrival directional identity (e.g., a perceivable phase shift); enhances hearing sensitivity upon listener approach (e.g., a tone-loudness shift); is easily and cost effectively electronically generatable; is identifiable (i.e. repeatable and differentiable from background noises); has consciously or subconsciously recognizable encoded relative angular direction; and has power efficient short sound durations and short sound intensity rise times. Preferably, the higher primary frequency sound is encoded complex noise which develops perceivable sound shadows that enable estimation of the angular direction of the sound's origin relative to the listener; is efficiently generated at high apparent ear intensity levels for reduced environmental attenuation and enhanced distance estimation; is identifiable (i.e., recognizable, repeatable, and differentiable from background noises); is of an efficient energy use short duration with short sound intensity rise times; and has enhanced front-to-back listener perceivable directional identity. A purpose of the "at least in part" language is to be certain that since more than one annunciator circuit may be used in any given device (more than one primary frequency is produced by having more than one tuned series of circuit elements) the section with elements having an RC time constant substantially in the range of from approximately 0.1 through about 1.0 millisecond is claimed, but the other circuit elements are not excluded. Aural stimuli is noise that people and animals can hear. Noise is an adiabatic compression wave carried in a media capable of supporting such transmissions.

As depicted in FIG. 5, the low ear intensity durations between high ear intensity sound durations are initially approximately 16 seconds and after approximately 4 minutes the low ear intensity durations are reduced to approximately 4 seconds.

Figure 6:
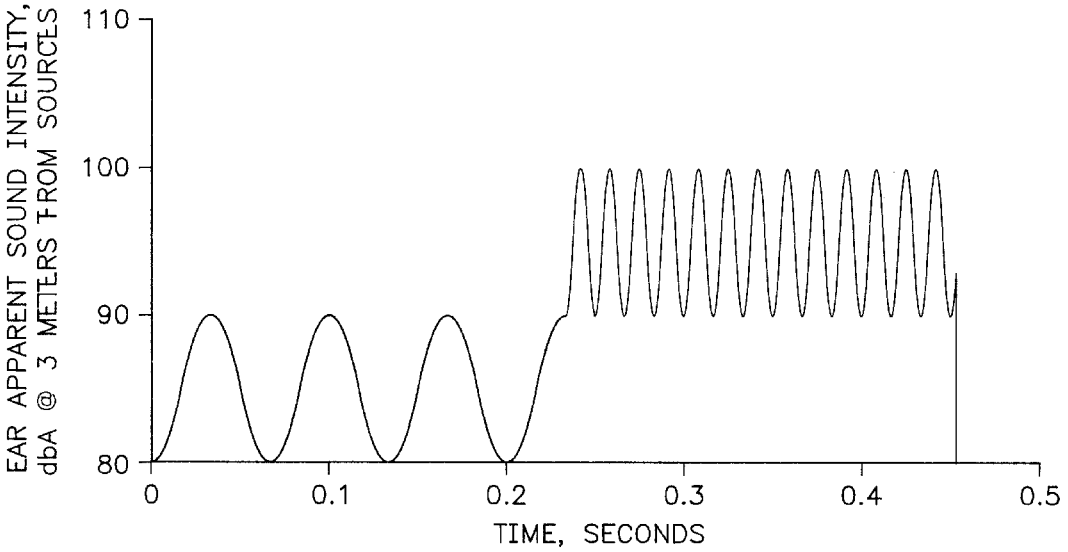
FIG. 6 is a graph depicting the inventive aural stimuli producing apparatus listener ear apparent encoded output sound intensities at 3 meters from the mid point between the two apparent sound sources on the apparatus, plotted as a function of time for one high ear intensity duration multiple primary frequency complex encoded noise output.

The audio stimuli are preferably split to emanate from a plurality of openings in the apparatus, thereby allowing the sounds to be heard from a plurality of angles relative to the apparatus and, because the origins of virtually identical sounds are separated spatially, producing sound interference patterns as depicted in FIG. 6. The specific constructive and destructive sound interference patterns heard by listeners vary with their distance from the object and the listeners' angles of orientation relative to the apparatus. FIG. 6 is a graph depicting the inventive aural stimuli generating apparatus' listener ear apparent encoded output sound intensity levels measured at 3 meters from the midpoint between two apparent sound sources on the apparatus, plotted as a function of time for one high ear intensity duration multiple primary frequency complex encoded noise output. FIG. 6 also illustrates the encoded spatial acoustic interference patterns produced as a result of constructive and destructive acoustic wave interference, which improve locatability of the inventive apparatus through the listeners' conscious or subconscious detection of phase shift; through low susceptibility to environmental attenuation; through tone-loudness shift; through sound shadows; through improved recognizability over background noise; and through enhanced front-to back listener directional identity.

The encoded aural stimuli method and apparatus described above result in: a novel, compact, portable, efficient encoding aural stimulator which a large percentage of human beings, (i.e. those with partial hearing impairment, such as high frequency deafness caused by age or a history of exposure to loud sounds, or deafness in one ear) can hear at great distances; encoded complex noises with sound phase shifts for enhanced directional location; tone-loudness shifts for enhanced distance estimation; sound shadows for enhanced directional locatability; enhanced front-to-back identifiable directional identity; and noise heard from a plurality of listener angles, thus enhancing quick aural locatability.

Figure 7:
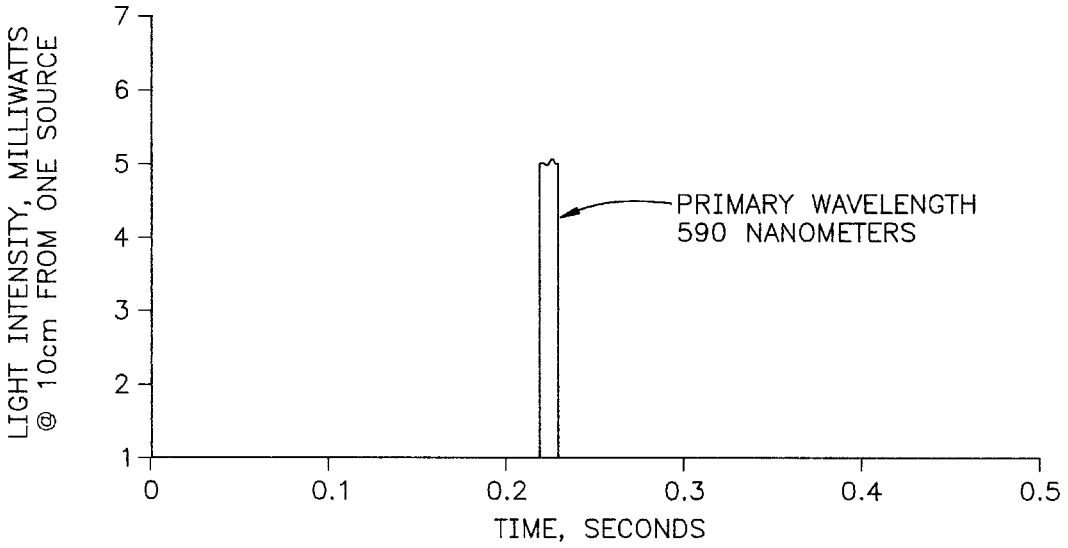
FIG. 7 is a graph of the inventive visual stimuli producing apparatus output depicting encoded light intensity in milliwatts, measured at 10 cm from one source, plotted as a function of time for one high intensity single pulse duration of coherent, near monochromatic encoded light.

The encoded visual stimuli generated through the Encodable Light circuit 30, as depicted in FIG. 7, preferably have maximum luminous flux with minimum energy consumption; have hue balanced luminous flux encoded pulses lasting approximately 0.01 second; are produced by an electronically controlled source with low intensity output durations between high intensity visual stimuli output durations of approximately initially 4 seconds and after approximately 224 seconds the low intensity durations are reduced to approximately 1 second each; and have an instantaneous apparent peak visible output intensity of about 5 milliwatts, measured at 10 cm from one light source, so that the light can be seen by individuals for up to hundreds of meters and yet not be of such a high intensity as to potentially damage human optic response. The encoded visual stimuli have a primary wavelength of approximately 590 nanometers, are coherent, near monochromatic light, and are pulsed and encoded through a light source having a high luminous power conversion efficiency. The coherent light beam is preferably split spatially through the use of such means as fiber optics so that viewer apparent multiple sources of near monochromatic coherent light produce interference patterns visible from a plurality of angles and distances.

The encoded visual stimuli method and apparatus described above result in novel, compact, portable, efficient encoding visual stimulators which a large percentage of humans, including those with partial vision impairment, such as anomalous and protanomalous color blindness, can see at great distances; produce encoded chromatic aberrations of the eye causing the visual stimulator to "glisten"; provide encoded interference patterns which may increase in spatial density as the visual stimulator is approached; and provide alerting locatable stimuli which may be seen from a plurality of angles, thus enhancing quick visual locatability.

Figure 8:
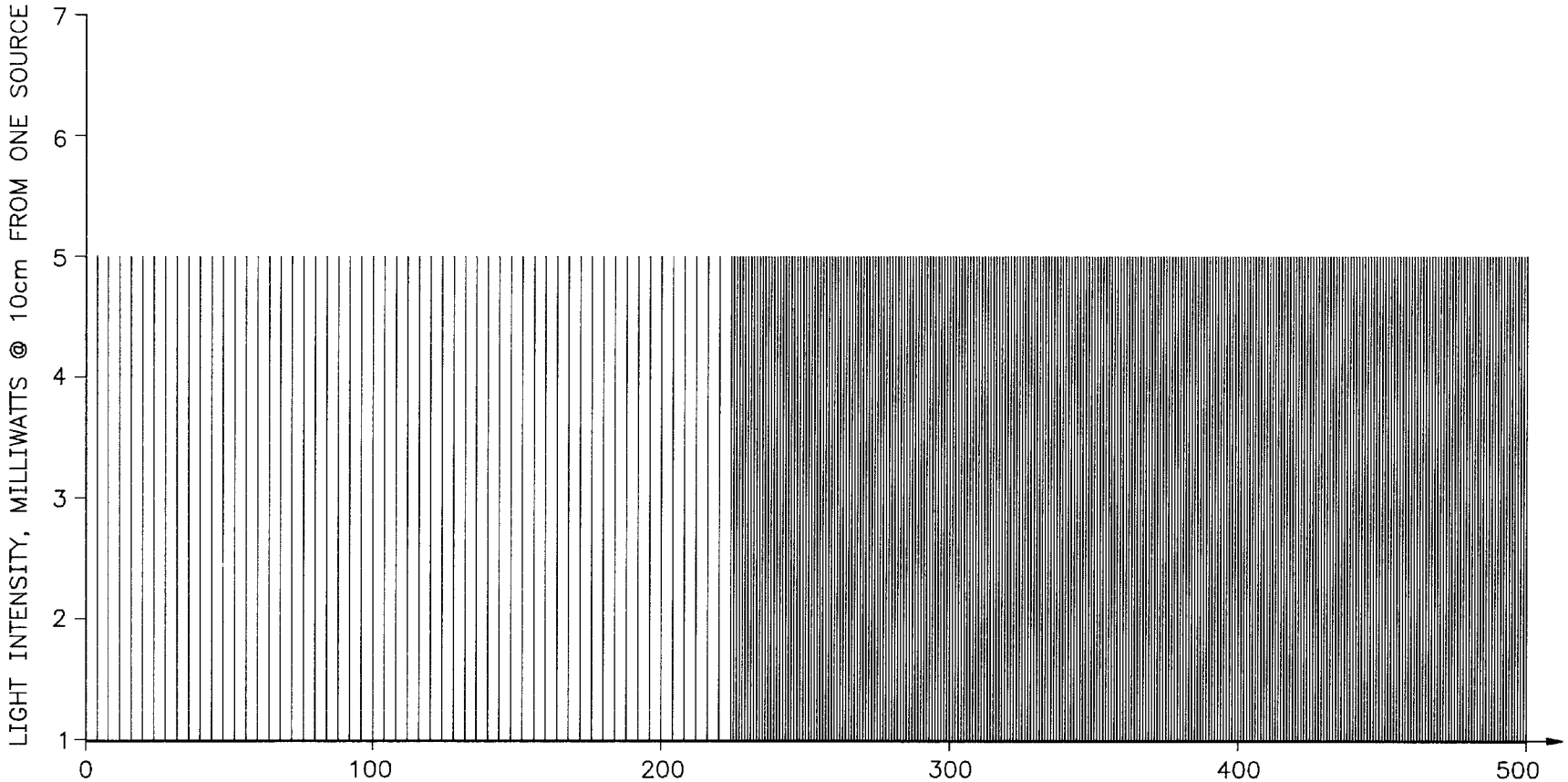
FIG. 8 is a graph of the inventive visual stimuli producing apparatus output depicting encoded light intensity in milliwatts, measured at 10 cm from one source, plotted as a function of time for a plurality of repetitive high and low light intensity durations of coherent, near monochromatic, encoded light.

FIG. 8 is a graph of the output from the inventive visual stimuli producing apparatus depicting encoded light intensity in milliwatts, measured at 10 cm from one source, plotted as a function of time for a plurality of repetitive high light intensity durations of coherent, near monochromatic, encoded light. The graph depicts the light intensity versus time for the first 500 seconds of inventive apparatus light provision, with the durations of low light intensity between high light intensity durations being approximately 4 seconds each for approximately the first 224 seconds of elapsed time following the initiation of inventive apparatus light provision and approximately 1 second each thereafter until light provision by the inventive apparatus ceases.

FIG. 9 is a graph depicting the inventive visual stimuli producing apparatus perceivable provided encoded light intensity in milliwatts, measured at 3 meters from the midpoint between two apparent light sources on the apparatus, plotted as a function of viewer relative angular position at a constant distance from the point midway between the two apparent light sources for one high light intensity duration of coherent, near monochromatic, encoded light output illustrating the encoded spatial light intensity interference pattern that varies with angular position of the viewer and is provided as a result of constructive and destructive near monochromatic, coherent light interference which may occur when multiple, near phase-identical light sources are visible and interacting. These patterns improve locatability of the inventive apparatus through the viewers' conscious or subconscious detection of the encoded patterns which may become spatially more dense as the apparatus is approached.

FIG. 10 is a graph of the output from the inventive aural and visual stimuli generating apparatus depicting encoded sound and light intensities, measured at 10 cm from one of each source, plotted as functions of time for one high intensity duration of multiple primary frequency, complex encoded noise stimuli and one high intensity duration of coherent, near monochromatic encoded light stimuli. The coordination of aural and visual stimuli combine to enhance listener/viewer alarm, awareness and locatability.

Figure 11:
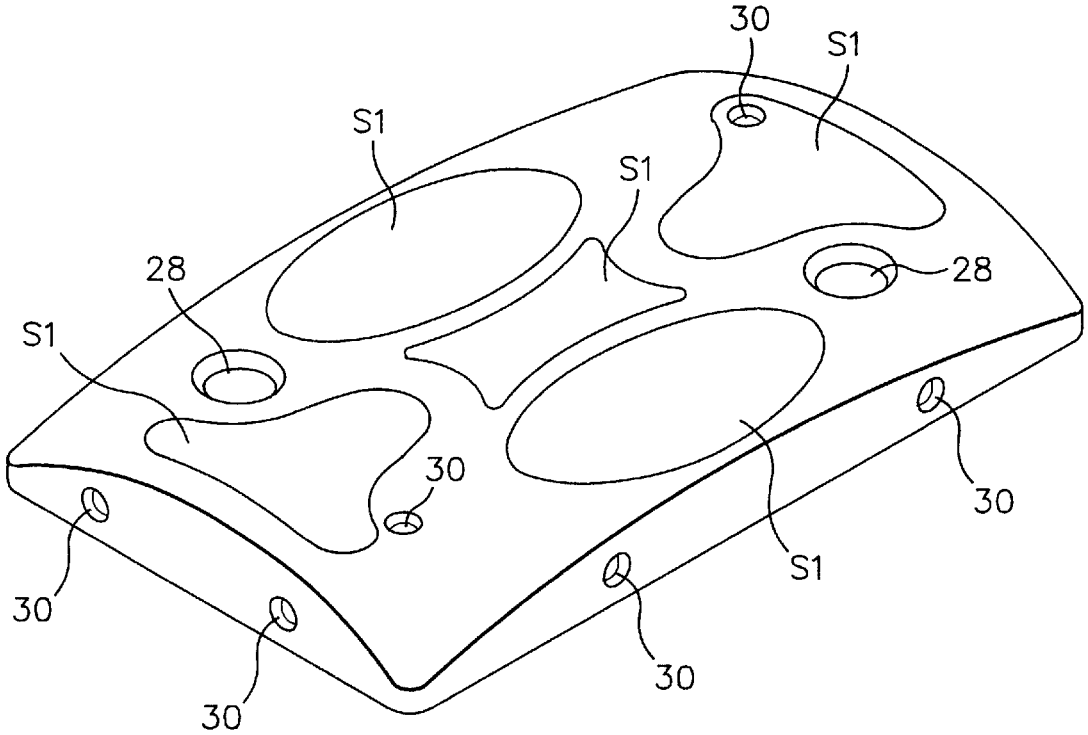
FIG. 11 is a depiction of the preferred locatable encoding aural and visual stimuli producing apparatus embodiment. The switch S1, which is a resistance sensitive switch, encodable annunciators 28, and encodable lights 30 are visible on and through the compound curved surfaces of the apparatus and the stimuli sources are audible and visible from a plurality of angles and apparatus positions.

FIG. 11 is an illustration of the preferred embodiment depicting the outer surface of the locatable encoding aural and visual stimuli generator apparatus on which multiple switches S1, Encodable Annunciator circuit openings 28, and Encodable Light circuit apertures 30 are apparent.

FIG. 12 is an illustration of the internal timing diagram of the signal relationships within the preferred embodiment and is described in detail in the initial part of the section entitled "Description of the Preferred Embodiment."

While the invention has been herein described by way of a particular preferred embodiment, various substitutions of equivalents may be effected without departing from the spirit and scope of the invention as set forth in the following claims.

What is claimed is:

1. Apparatus for increasing awareness of and locatability of an object by an individual, said apparatus comprising:

(a) means for causing light visual stimuli encoding modification;

(b) said means for causing light visual stimuli encoding modification providing light visual stimuli substantially in the wavelength range of approximately 380 nanometers through 780 nanometers;

(c) said means for causing light visual stimuli encoding modification providing light visual stimuli from which said individual may consciously and subconsciously estimate the relative distance between said individual and said object;

(d) said means for causing light visual stimuli encoding modification providing light visual stimuli from which said individual may consciously and subconsciously estimate at least two relative angles between said individual and said object;

(e) means for causing encoding light modification that modifies light in at least one or more temporal and spatial variations which include high intensity durations and low intensity durations;

(f) said encoding light visual stimuli modification means providing high intensity durations substantially in the range of 0.0001 second through 0.1 second; and (g) said encoding light means providing low intensity durations substantially in the range of 0.01 second through 45 seconds.

2. Apparatus comprising an encoding aural stimuli controlling and providing circuit for increasing awareness of and locatability of an object by an individual, wherein the circuit comprises:

(a) a counter/timer frequencies regenerator encoder circuit;

(b) a reset sub-circuit;

(c) a state sequence counter/enabler circuit;

(d) an aural amplifier circuit;

(e) an encodable annunciator circuit;

(f) a switch circuit;

(g) a power source; and (h) a switch controller comparator circuit.

3. Apparatus comprising an encoding visual stimuli providing circuit for increasing awareness of and locatability of an object by an individual, wherein the circuit comprises:

(a) a counter/timer frequencies generator encoder circuit;

(b) a reset sub-circuit;

(c) a state sequence counter/enabler circuit (d) a visual amplifier circuit;

(e) an encodable light visual stimuli circuit;

(f) a switch circuit;

(g) a power source; and (h) a switch controller comparator circuit.

4. Apparatus comprising an aural and visual stimuli providing circuit for increasing awareness of and locatability of an object by an individual, wherein the aural and visual stimuli providing circuit comprises:

(a) a counter/timer, frequencies generator encoder circuit comprising a plurality of counter flip-flops to generate:

a clock signal CLK within the counter/timer frequencies generator encoder circuit;

a clock signal CLK1 to a switch controller/comparator circuit;

a clock signal CLK2 to a state sequence counter/enabler circuit;

a clock signal CLK3 to a state sequence counter/enabler circuit;

a clock signal CLK4 to a state sequence counter/enabler circuit;

a clock signal CLK5 to a state sequence counter/enabler circuit;

a visual switch control signal VISUAL to a visual amplifier and switch circuit; and an aural switch control signal NOISE to an aural amplifier and switch circuit;

(b) a reset sub-circuit generating a reset signal RESET to clear a state of a state sequence counter/enabler circuit;

(c) a switch circuit generating a reset signal RST to clear a state of a switch controller/comparator circuit and a state of a counter/timer, frequencies generator encoder circuit;

(d) a state sequence counter/enabler circuit comprising a plurality of counter flip-flops generating an enable signal ENABLE A to the aural amplifier and switch circuit to enable the aural amplifier and switch circuit, and an enable signal ENABLE V to the visual amplifier and switch circuit to enable the visual amplifier and switch circuit;

(e) said switch controller/comparator circuit generating a clear signal CLEAR to initialize said state sequence counter/enabler circuit;

(f) said aural amplifier and switch circuit comprising an encodable annunciator circuit;

(g) said aural amplifier and switch circuit generating an aural driver signal AURAL AMP to the encodable annunciator circuit;

(h) said encodable annunciator circuit producing complex encoded audible noise aural stimuli;

(i) said visual amplifier and switch circuit comprising an encodable light visual stimuli;

(j) said visual amplifier and switch circuit generating a visual driver signal VISUAL AMP to the encodable light visual stimuli circuit;

(k) said encodable light circuit producing visible encoded light visual stimuli; and (l) a power source.

5. Apparatus for increasing awareness of and locatability of an object by an individual as described in claim 2, wherein the apparatus further comprises the step of combining said apparatus with the object.

6. Apparatus for increasing awareness of and locatability of an object by an individual as described in claim 3, wherein the apparatus further comprises combining said apparatus with the object.

7. Apparatus for increasing awareness of and locatability of an object by an individual as described in claim 4 wherein the apparatus further comprises combining said apparatus with the object.

8. Method for increasing awareness of and locatability of an object by an individual, said method comprising the steps:

(a) providing light visual stimuli encoding modification;

(b) providing said light visual stimuli substantially in the wavelength range of 380 through 780 nanometers;

(c) providing said light visual stimuli from which said individual may consciously and subconsciously estimate the relative distance between said individual and said object;

(d) providing said light visual stimuli from which said individual may consciously and subconsciously estimate at least two relative angles between said individual and said object;

(e) causing encoding light modification in at least one or more temporal and spatial variations which include high intensity durations and low intensity durations;

(f) causing encoding light visual stimuli modification in high intensity durations substantially in the range from 0.0001 second through 0.1 second; and (g) causing low intensity durations substantially in the range from 0.01 second through 45 seconds.

9. Method for increasing awareness of and locatability of an object by an individual, said method comprising the steps of:

(a) providing intermittent encoded noise aural stimuli;

(b) providing said intermittent encoded noise aural stimuli from which said individual may consciously and subconsciously estimate the relative distance between said individual and said object;

(c) providing said intermittent encoded noise aural stimuli from which said individual may consciously and subconsciously estimate at least two relative angles between said individual and said object;

(d) providing said intermittent encoded noise aural stimuli at primary frequencies in the range of less than 15 kHz;

(e) providing intermittent encoded light visual stimuli;

(f) providing intermittent encoded light visual stimuli substantially in the wavelength range of less than 780 nanometers;

(g) providing intermittent encoded light visual stimuli from which said individual may consciously and subconsciously estimate the relative distance between said individual and said object;

(h) providing intermittent encoded light visual stimuli from which said individual may consciously and subconsciously estimate at least two relative angles between said individuals and said object;

(i) providing at least two ear-perceivable frequencies;

(j) said frequencies being distinct and substantially different from one another;

(k) providing at least a portion of said high ear intensity level complex encoded noise aural stimuli at primary frequencies in the range of 740 Hz at high ear intensity levels in the range of 88 dbA measured at 10 cm from the source of said complex encoded noise aural stimuli;

(l) providing at least a portion of said high ear intensity level complex encoded noise aural stimuli at primary frequencies in the range of 6.4 kHz at high ear intensity levels in the range of 95 dbA measured at 10 cm from the source of said noise aural stimuli;

(m) providing at least a portion of intermittent durations of said noise aural stimuli at primary frequencies in the range of said 740 Hz and in the range of said 6.4 kHz;

(n) providing durations of said intermittent high ear intensity level complex encoded noise aural stimuli in the range of 0.01 second through 0.6 second;

(o) providing low ear intensity level noise at ear intensity levels less than 50 dbA measured at 10 cm from the source of said low ear intensity level noise;

(p) providing at least a portion of durations of said low ear intensity level noise between said durations of said high ear intensity level intermittent complex encoded noise aural stimuli which are initially for the first 4 minutes of operation in the range of 16 seconds;

(q) providing at least a portion of durations of said low ear intensity level noise between said durations of said high ear intensity level intermittent complex encoded noise aural stimuli which after the first 4 minutes of operation are in the range of 4 seconds;

(r) providing at least a portion of said low and high ear intensity level noise from an apparent plurality of locations;

(s) providing at least a portion of said low and high ear intensity level noise from an encodable annunciator circuit having an RC time constant in the range of 0.1 through 1.0 millisecond; and (t) providing at least a portion of said high ear intensity level complex encoded noise durations in the range of 0.23 second.

10. Method for increasing awareness of and locatability of an object by an individual according to claim 8, wherein said method of producing intermittent encoded light visual stimuli further comprises the steps of:

(a) providing said intermittent encoded light visual stimuli primarily in the visible wavelength range that individuals substantially perceive as having high lumen sight efficiency;

(b) providing said light visual stimuli with a high light visual stimuli source efficiency;

(c) balancing said light visual stimuli substantially between saturation and brightness to produce high brightness sensation and high light visual stimuli source power efficiency;

(d) providing said light visual stimuli with mostly balanced primary light visual stimuli properties of luminous flux, chromaticity and saturation purity to produce high ocular response and recognizability; and (e) providing said light visual stimuli in near monochromatic mostly coherent light.

11. Method for increasing awareness of and locatability of an object by an individual, said method comprising the steps of:

(a) providing intermittent encoded noise aural stimuli;

(b) providing intermittent encoded light visual stimuli;

(c) providing said intermittent encoded light visual stimuli primarily in the visible wavelength range that individuals substantially perceive as having high lumen sight efficiency that stimulates a heightened perception of brightness for the actual light perceived;

(d) providing said intermittent encoded light visual stimuli with a high light visual stimuli source power use efficiency;

(e) providing said intermittent encoded light visual stimuli balanced substantially between saturation and brightness to produce high brightness sensation for said individual and high light visual stimuli source power use efficiency;

(f) providing said intermittent encoded light visual stimuli with mostly balanced primary light visual stimuli properties of luminous flux, chromaticity and saturation purity to produce high ocular response and recognizability; and (g) providing at least a portion of said intermittent encoded light visual stimuli as near monochromatic light substantially in the primary wavelength range of from about 555 nanometers through approximately 595 nanometers.

12. Method for increasing awareness of and locatability of an object by an individual according to claim 10, wherein the method of providing encoded light visual stimuli further comprises the step of splitting at least a portion of said light visual stimuli whereby said light visual stimuli output is apparent from a plurality of locations relative to the apparatus and wherein producing at least a partial light visual stimuli interference pattern.

13. Method for increasing awareness of and locatability of an object by an individual as described in claim 8, wherein the method further comprises the step of combining said method with said object.

14. Method for increasing awareness of and locatability of an object by an individual, said method comprising the steps of:

(a) providing intermittent encoded noise aural stimuli;

(b) providing intermittent encoded light visual stimuli;

(c) said intermittent encoded noise aural stimuli method providing at least two ear perceivable frequencies;

(d) providing said intermittent encoded noise aural stimuli at said two frequencies distinct and substantially different from one another;

(e) providing at least a portion of said intermittent high ear intensity level complex encoded noise aural stimuli at primary frequencies substantially in the range of 740 kHz and at high ear intensity levels substantially in the range of 88 dbA, measured at about 10 cm from the source of said complex encoded noise aural stimuli;

(f) providing at least a portion of said high ear intensity level complex encoded noise aural stimuli at primary frequencies substantially in the range of 6.4 kHz at high ear intensity levels substantially in the range of 95 dbA, measured at about 10 cm from the source of said noise aural stimuli;

(g) providing durations of said intermittent high ear intensity level complex encoded noise aural stimuli substantially in the range of from approximately 0.01 second through approximately 0.6 second;

(h) providing low ear intensity level noise at ear intensity levels less than approximately 50 dbA, measured at about 10 cm from the source of said low ear intensity level noise;

(i) providing durations of said low ear intensity level noise, between said durations of said high ear intensity level intermittent complex encoded noise aural stimuli, which are initially and substantially for the first 4 minutes of operation substantially in the range of 16 seconds;

(j) providing durations of said low ear intensity level noise, between said durations of said high ear intensity level intermittent complex encoded noise aural stimuli, which after approximately the first 4 minutes of operation are substantially in the range of 4 seconds;

(k) providing at least a portion of said low and high ear intensity level noise from an encodable annunciator circuit having an RC time constant substantially in the range of from approximately 0.1 through 1.0 millisecond; and (l) providing at least a portion of said high ear intensity level complex encoded noise durations substantially in the range of about 0.23 second.

15. Method for increasing awareness of and locatability of an object by an individual comprising providing encoded aural stimuli from a circuit, wherein the method of providing stimuli from the circuit comprises the steps of:

(a) modifying and producing encoded aural stimuli;

(b) providing a counter/timer frequencies generator encoder circuit;

(c) including a reset sub-circuit;

(d) providing a state sequence counter/enabler circuit;

(e) including an aural amplifier circuit;

(f) providing an encodable annunciator circuit;

(g) including a switch;

(h) providing a power source; and (i) including a switch controller comparator circuit.

16. Method for increasing awareness of and locatability of an object by an individual comprising providing encoded visual stimuli from a circuit, wherein the method of providing stimuli from the circuit comprises the steps of:

(a) modifying and producing encoded visual stimuli;

(b) providing a counter/timer frequencies generator encoder circuit;

(c) including a reset sub-circuit;

(d) providing a state sequence counter/enabler circuit;

(e) including a visual amplifier circuit;

(f) providing an encodable light circuit;

(g) including a switch;

(h) providing a power source; and (i) including a switch controller comparator circuit.

17. Method for increasing awareness of and locatability of an object by an individual comprising providing encoded aural and visual stimuli from a circuit, wherein said method of providing the aural and visual stimuli circuit comprises the steps of:

(a) providing a counter/timer, frequencies generator encoder circuit comprising using a plurality of counter flip-flops to generate:

a clock signal CLK within the counter/timer, frequencies generator encoder circuit;

a clock signal CLK1 to a switch controller/comparator circuit;

a clock signal CLK2 to a state sequence controller/enabler circuit;

a clock signal CLK3 to a state sequence counter/enabler circuit;

a clock signal CLK4 to a state sequence controller/enabler circuit;

a clock signal CLK5 to a state sequence counter/enabler circuit;

a visual switch control signal VISUAL to a visual amplifier and switch circuit; and an aural switch control signal NOISE to an aural amplifier and switch circuit;

(b) using a reset sub-circuit to provide a reset signal RESET to clear a state of a state sequence counter/enabler circuit;

(c) using a switch circuit to generate a reset signal RST to clear a state of a switch controller/comparator circuit and a state of a counter/timer, frequencies generator encoder circuit;

(d) using a state sequence counter/enabler circuit comprising using a plurality of counter flip-flops to generate an enable signal ENABLE A to the aural amplifier and switch circuit to enable the aural amplifier and switch circuit and an enable signal ENABLE V to the visual amplifier and switch circuit to enable the visual amplifier and switch circuit;

(e) using the switch controller/comparator circuit to generate a clear signal CLEAR to initialize a state sequence counter/enabler circuit;

(f) using said aural amplifier and switch circuit comprising an encodable annunciator circuit;

(g) using said aural amplifier and switch circuit to generate an aural driver signal AURAL AMP to the encodable annunciator circuit;

(h) using said encodable annunciator circuit to produce complex encoded audible noise aural stimuli;

(i) using said visual amplifier and switch circuit comprising an encodable light visual stimuli circuit;

(j) using said visual amplifiers and switch circuit to generate a visual driver signal VISUAL AMP to the encodable light visual stimuli circuit;

(k) using said encodable light circuit to produce visible encoded light visual stimuli; and (l) using a power source.

18. Method for increasing alarm, awareness of and locatability of an object by an individual, said method comprising;

(a) providing at least a portion of two ear perceivable encoded noise aural stimuli in at least two distinct frequencies;

(b) providing at least a portion of said ear perceivable encoded noise aural stimuli as distinct pulsed durations;

(c) providing at least a portion of said ear perceivable encoded noise aural stimuli as high ear intensity level complex encoded noise aural stimuli;

(d) providing at least a portion of said ear perceivable durations as periods of low ear intensity level noise, which are substantially in the range of from approximately one tenth second through approximately sixty seconds;

(e) providing at least a portion of said high ear intensity level complex noise aural stimuli as durations of rapid low to high ear intensity rise time encoded complex noise aural stimuli substantially in the high ear intensity range of approximately 50 to 150 dbA as measured at 10 cm from the source;

(f) providing said rapid rise time high ear intensity encoded complex noise aural stimuli intervals substantially in the primary frequency range of less than approximately 15 kHz; and (g) providing said rapid rise time high and low ear intensity perceived encoded noise aural stimuli durations at substantially duplicated primary frequency and ear perceived intensity so as to enhance both an individual's perceptions of relative distance to and change in relative distance from said object.

19. Apparatus for increasing awareness of and locatability of an object by an individual, said apparatus comprising:

(a) means for providing at least a portion of two ear perceivable encoded noise aural stimuli in at least two distinct frequencies;

(b) means for providing at least a portion of said ear perceivable encoded noise aural stimuli as distinct pulsed durations;

(c) means for providing at least a portion of said ear perceivable encoded noise aural stimuli as high ear intensity level complex encoded noise aural stimuli;

(d) means for providing at least a portion of said ear perceivable durations as periods of low ear intensity level noise, which are substantially in the range of from approximately one tenth second through approximately sixty seconds;

(e) means for providing at least a portion of said high ear intensity level complex noise aural stimuli as durations of rapid low-to-high ear intensity rise time encoded complex noise aural stimuli substantially in the high ear intensity range of approximately 50 to 150 dbA as measured at 10 cm from the source;

(f) means for providing said rapid use time high ear intensity encoded complex noise aural stimuli intervals substantially in the primary frequency range of less than approximately 15 kHz; and (g) means for providing said rapid rise time high and low ear intensity perceived encoded noise aural stimuli durations at substantially duplicated primary frequency and ear perceived intensity so as to enhance both an individual's perceptions of relative distance to and change in relative distance from said object.

20. Method for increasing awareness of and locatability of an object by an individual, said method comprising the steps of:

(a) providing light visual stimuli encoding modification;

(b) providing at least a portion of said light visual stimuli encoding modification substantially in the wavelength range of less than 780 nanometers;

(c) providing at least a portion of said light visual stimuli encoding modification substantially in at least one or more temporal and spatial variations;

(d) providing at least a portion of said light visual stimuli encoding modification as low intensity durations that are substantially intermittent;

(e) providing at least a portion of said light visual stimuli encoding modification in two or more wavelength ranges that are distinct and substantially different from one another;

(f) providing at least a portion of said light visual stimuli encoding modification in at least two or more intensities that are distinct and substantially different from one another; and (g) providing at least a portion of said light visual stimuli encoding modification as substantially duplicated distinct pulsed durations that enhance both an individual's conscious and subconscious perceptions of relative distance to and change in relative distance from said object.

21. Apparatus for increasing awareness of and locatability of an object by an individual, said apparatus comprising:

(a) means for causing light visual stimuli encoding modification;

(b) said means providing at least a portion of light visual stimuli substantially in the wavelength range of less than 780 nanometers;

(c) said means providing at least a portion of said light visual stimuli encoding modification substantially in at least one or more temporal and spatial variations;

(d) said means providing at least a portion of said light visual stimuli as low intensity durations that are substantially intermittent;

(e) said means providing at least a portion of said light visual stimuli encoding modification in two or more wavelength ranges that are distinct and substantially different from one another;

(f) said means providing at least a portion of said light visual stimuli encoding modification in at least two or more intensities that are distinct and substantially different from one another; and (g) said means providing at least a portion of said light visual stimuli encoding modification as substantially duplicated distinct pulsed durations that enhance both an individual's conscious and subconscious perceptions of relative distance to and change in relative distance from said object.

22. Method for increasing awareness of and locatability of an object by an individual as described in claim 18, wherein the method further comprises the step of combining said method with said object.

23. Apparatus for increasing awareness of and locatability of an object by an individual as described in claim 19, wherein the apparatus further comprises the step of combining said apparatus with the object.

24. Method for increasing awareness of and locatability of an object by an individual as described in claim 20, wherein the method further comprises the step of combining said method with said object.

25. Apparatus for increasing awareness of and locatability of an object by an individual as described in claim 21, wherein the apparatus further comprises the step of combining said apparatus with the object.

* * * * *